United States Patent [19]

Messersmith

[11] 4,237,928

[45] Dec. 9, 1980

[54] LOW PROFILE TAPERED SUMP FOR RAILWAY TANK CARS

[75] Inventor: Robert C. Messersmith, St. Charles, Mo.

[73] Assignee: ACF Industries, Incorporated, New York, N.Y.

[21] Appl. No.: 42,832

[22] Filed: May 29, 1979

[51] Int. Cl.[3] ..... B65D 87/24

[52] U.S. Cl. ..... 137/590; 137/152; 137/350

[58] Field of Search ..... 251/144; 137/590, 347, 137/350, 152, 153

[56] References Cited

U.S. PATENT DOCUMENTS

| | | | |
|---|---|---|---|
| 1,894,655 | 1/1933 | Auchincloss | 251/144 X |
| 2,174,354 | 9/1939 | Shields | 137/590 X |
| 4,114,783 | 9/1978 | Wempe et al. | 222/398 |
| 4,180,242 | 12/1979 | Reedy | 251/144 |
| 4,184,511 | 1/1980 | Wilson | 137/590 |
| 4,184,663 | 1/1980 | Rollins et al. | 251/144 |

*Primary Examiner*—William R. Cline
*Attorney, Agent, or Firm*—Henry W. Cummings

[57] ABSTRACT

In accordance with the present invention, a low profile, tapered siphon pipe sump is provided including a sump portion located below an opening in the tank bottom and extending below the tank bottom and a tapered portion extending longitudinally in both directions from the sump portion. The sump portion includes a sump opening sufficiently deep to readily unload through a siphon pipe the remaining portion of the lading in the tank, sufficiently deep to enable the siphon pipe to telescope therein when the tank top moves downwardly relative to the tank bottom during coupling impacts, and is also sufficiently wide and deep to enable a rubber spider siphon pipe guide normally used in rubber lined tank cars to position and anchor itself in the sump. This invention is also adaptable to unlined tank cars. The tapered portion extends from the bottom of the sump portion longitudinally of the tank in both directions. The tapered portion is tapered upwardly from the sump portion to a tapered end portion engaging the bottom of the tank. The tapered portion preferably extends three (3) longitudinal units for each vertical unit that the tapered portion extends below the tank bottom.

6 Claims, 4 Drawing Figures

LOW PROFILE TAPERED SUMP FOR RAILWAY TANK CARS

BACKGROUND OF THE INVENTION

In application Ser. No. 905,499 filed May 12, 1978, a continuous cradle pad is disclosed which extends throughout the length of a stub sill railway tank car. A reinforcing plate and a protective skid are provided to protect a tank car lading valve for bottom unloading and/or a tank car sump for top unloading, both of which normally project below the tank bottom in excess of one (1) inch. However, this continuous cradle pad, reinforcing plate and skid add a great deal of weight to the car, and thus reduce the allowable weight for lading. Furthermore, the cost of fabricating and welding in place the continuous cradle pad, reinforcing plate and skid add considerable cost.

In U.S. Pat. No. 4,114,783 granted Sept. 19, 1978, a low profile sump is disclosed which does not extend below the tank bottom in excess of one (1) inch and thus a protective skid is not required to comply with AAR and DOT regulations concerning projections extending below the tank bottom. However, the shallow depth of this sump often makes it difficult to remove the last portion of the lading in the bottom of the tank and requires a costly telescoping siphon pipe arrangement.

In rubber lined tank cars it is desirable to utilize a siphon pipe guide, or rubber spider, positioned within the sump to prevent the siphon pipe from moving horizontally or laterally within the sump and possibly breaking off near the top of the of the tank due to metal fatigue. This rubber guide cannot fit within the low profile sump disclosed in U.S. Pat. No. 4,114,783.

In application Ser. No. 860,987 filed Dec. 15, 1977, now U.S. Pat. No. 4,184,633, a combination tank car valve seat and skid for bottom unloading is disclosed in which, in one embodiment, the skid is welded to the tank bottom.

SUMMARY OF THE INVENTION

The object of the present invention is to provide a tapered, low profile tank car sump and skid for railway tank cars, particularly DOT-111A class tank cars, and which complies with AAR and DOT regulations concerning projections extending below the tank bottom.

Another object is to reduce the weight caused by the use of a continuous stub sill cradle pad, a skid reinforcing pad and a protective skid.

Another object is to provide a sump which will also allow the use of the rubber spider siphon pipe guide normally used in rubber lined tank cars.

In accordance with the present invention, a low profile, tapered siphon pipe sump is provided including a sump portion located below an opening in the tank bottom and extending below the tank bottom and a tapered portion extending longitudinally in both directions from the sump portion. The sump portion includes a sump opening sufficiently deep to readily unload through a siphon pipe the remaining portion of the lading in the tank, sufficiently deep to enable the siphon pipe to telescope therein when the tank top moves downwardly relative to the tank bottom during coupling impacts, and is also sufficiently wide and deep to enable a rubber spider siphon pipe guide normally used in lined tank cars to position and anchor itself in the sump.

The tapered portion of the present invention is tapered upwardly from the sump portion to an end portion engaging the bottom of the tank. The tapered portion preferably extends three (3) longitudinal units for each vertical unit. The tapered portion also extends a short distance transversely of the tank. The low profile sump is rigidly attached to the tank bottom adjacent the sump opening and at the tapered end portion by welding.

The sump opening is conveniently formed as a half of a sphere having a diameter of at least about seven and three-fourths ($7\frac{3}{4}$) inches. Void spaces are preferably provided in the tapered portion which extend longitudinally of the car and transversely of the tank to save weight. The void spaces also avoid shrink problems during casting, if the low profile sump is formed by casting.

THE DRAWINGS

DESCRIPTION OF PREFERRED EMBODIMENTS

Figure 2:
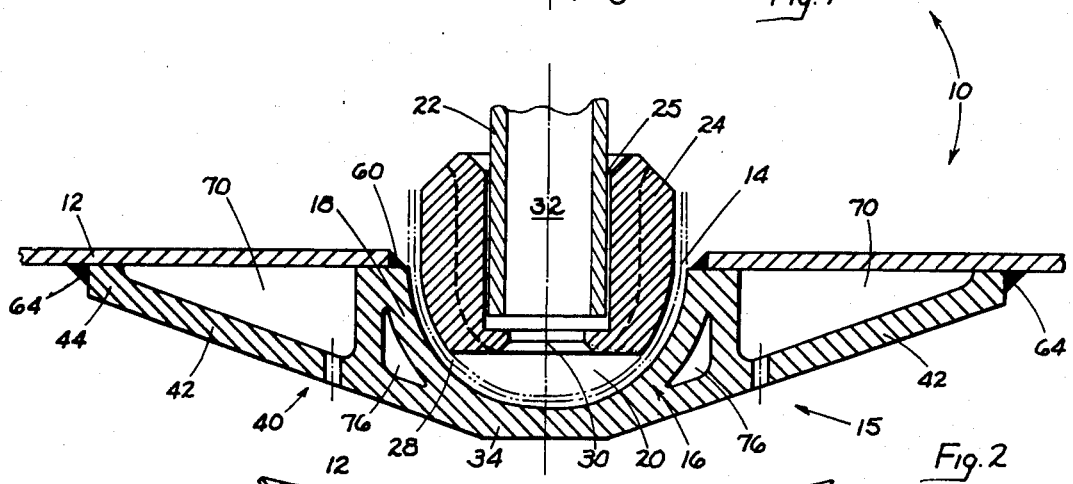
FIG. 2 is a sectional view looking in the direction of the arrows along the line 2—2 in FIG. 1, including the tank bottom.
Figure 3:
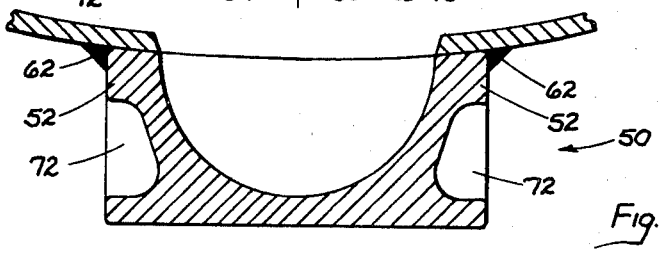
FIG. 3 is a sectional view looking in the direction of the arrows along the line 3—3 in FIG. 1.

The low profile tank car sump is indicated in the drawings generally at 10. The tank car bottom 12 includes a sump opening 14. Opening 14 is conveniently circular. The low profile sump 15 includes a sump portion indicated generally at 16. The sump portion 16 includes a wall portion 18 which defines a sump opening 20. The opening 20 is sufficiently deep that the lading is readily unloaded through a siphon pipe 22 of known construction, is sufficiently deep to enable the siphon pipe 22 to telescope within the sump opening when the car is impacted and also is sufficiently wide and deep to enable a rubber spider siphon pipe guide indicated at 24 normally used in rubber lined tanks to fit into the sump as shown in FIG. 2 when the car is impacted.

The rubber guide 24 is generally circular and includes a plurality of drainage passages 27 formed by outwardly extending lugs 26. Thus, to accommodate this rubber spider siphon pipe guide, it is preferred that the sump opening of the present invention also be circular in cross section and is conveniently formed in a half a sphere to achieve the desired minimum three-eighths ($\frac{3}{8}$) inch clearance to allow for two (2) layers of three-sixteenths (3/16) inch rubber lining on the sump wall. It is preferred that the sphere have a radius of at least about three and seven-eighths ($3\frac{7}{8}$) inches. It is to be noted that lower portion 28 of the guide is curved. For rubber lined tanks, the guide 24 is preferably made of the same material as the lining, generally rubber, and is generally attached to the siphon pipe 22 by means of an adhesive 25. The guide 24 further includes a center opening 30 which communicates with a cooperating opening 32 in the siphon pipe to remove the lading from the top of the tank in a known manner.

The tapered portion indicated generally at 40 includes a wall portion 42 which joins, or is integral with, the bottom 34 of the sump. Plate or wall portion 42 is tapered outwardly and upwardly from the bottom 34 of the sump portion up to an end portion 44 which abuts the tank bottom 12. The tapered portion 40 preferably extends longitudinally three (3) units for each vertical unit to comply with AAR and DOT regulations concerning projections extending below the tank bottom. For example, if the lower surface of the sump bottom 34 extends three and three-fourths ($3\frac{3}{4}$) inches below the lower corner and end portion 44, the skid portion 40 should extend eleven and one-fourth ($11\frac{1}{4}$) inches from the flat portion of the lower surface of the sump portion 34 to comply with the AAR and DOT regulations requiring three (3) longitudinal units of skid for each vertical unit.

The tapered portion also includes a transverse portion indicated generally at 50. The transverse portion is relatively short as compared to the longitudinal portion. For example, when the sump bottom is four and five-eighths ($4\frac{5}{8}$) inches from the tank bottom, the transverse portion 50 needs only extend about five and three-eighths ($5\frac{3}{8}$) inches from the transverse center of the sump.

The low profile sump is rigidly attached to the tank bottom. This is most conveniently done by welding. A weld 60 is provided along the upper periphery of the sump portion joining the sump to the inner edge of the tank bottom 12. In addition, a weld 62 is provided between the transverse flange portion 52 and the lower surface of the tank bottom. Another weld 64 is provided at the end portions 44 of the longitudinal skid portion 40 joining the skid end portion to the tank bottom.

Figure 4:
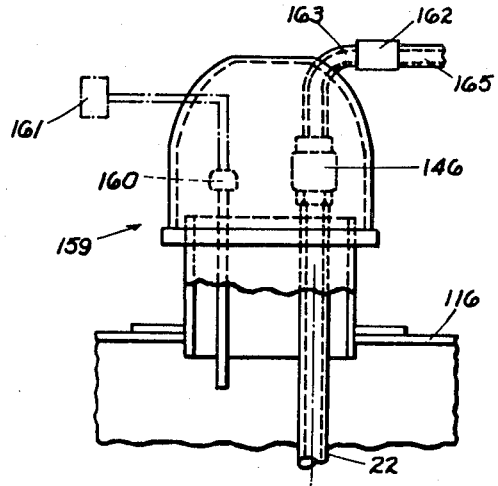
FIG. 4 is a partial vertical sectional view taken at the top of the car.
Figure 1:
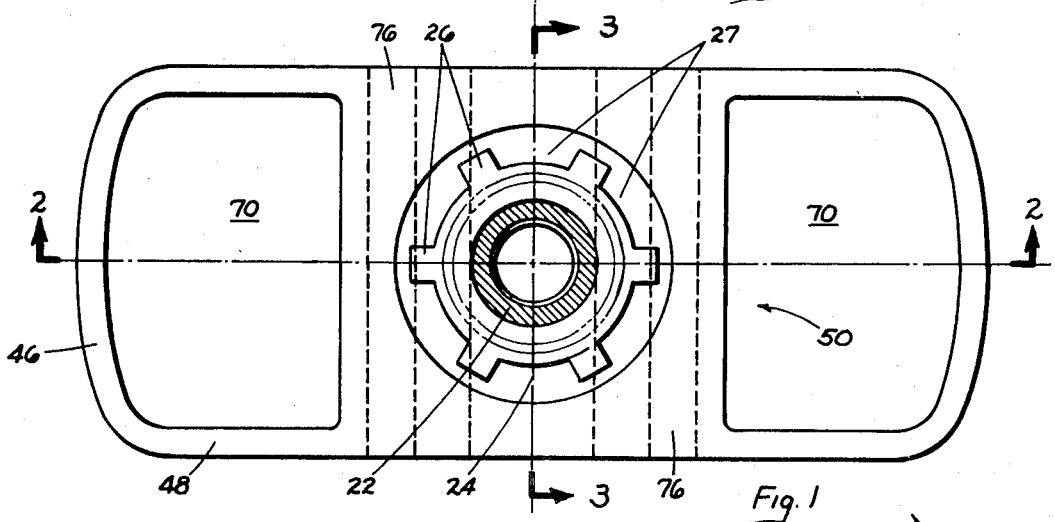
FIG. 1 is a plan view of the combination tank car sump and skid of the present invention without the tank bottom.

It is to be noted that the skid is generally rectangular. However, end portion 44 is provided with a slight curvature as indicated at 46 in FIG. 1 where it engages the tank bottom.

To save weight, void spaces are preferably provided in the combination sump and skid. A first and large void portion 70 is provided in the longitudinal portion about the plate or wall 42. With the provision of void space 70, wall portion 42 is curved upwardly and includes a wall portion 48 (FIG. 1) which engages the tank bottom. A second void portion 72 is provided in the skid transverse portion 50. Void portion 72 is located below the flange portion 52 which is welded to the tank bottom and outwardly of the sump wall 18. A third void portion 76 is provided generally in the sump portion. Void portion 76 extends transversely of the tapered sump.

It will be apparent that formation of the void portions 70, 72 and 74 is most conveniently formed in a casting. However, the low profile sump and skid of the present invention are not to be limited to a casting, rather, a fabrication or forging could be used for some or all of the low profile sump.

The technique for unloading the lading through the sump 16 and the siphon pipe 32 is disclosed in U.S. Pat. No. 4,114,783 and is hereby incorporated into the present application by this reference.

Briefly, pipe 22 extends through the top of the car 116 and is provided with an outlet valve 146. Means 159 are provided to provide a pressure differential between valve means 146 and the sump 16. An air inlet valve 160 of conventional construction is provided to apply pressure from a pressure source 161 to the lading to force the lading up through pipe 24. Alternatively, a conventional pump 162 may be connected to outlet valve 146 through a conduit 163. An unloading hose or pipe 165 is attached to unloading valve 146 or to an unloading pump 162 to carry the lading to a receiving container.

When the car is impacted as during switching or over-the-road operation, the tank top 116 and pipe 24 move downwardly relative to the tank bottom 142. Pipe 22 and siphon pipe guide 24 telescope into sump 16 to the extent that the tank top 116 moves downwardly relative to the tank bottom 12.

The low profile, tapered sump, in accordance with the invention, extends only a short distance below the outside of tank bottom 12 so that a skid is not required to meet AAR regulations. At the same time, the tank top and pipe guide 24 may move downwardly under impact into sump 16 without striking the bottom of the sump.

What is claimed is:

1. A low profile tank car siphon pipe sump comprising: a sump portion located below an opening in the tank bottom having a lining located on said tank bottom and extending through said sump; said sump extending below said tank bottom; said sump portion including a sump opening sufficiently deep to readily unload through a siphon pipe the remaining portion of the lading in the tank; sufficiently deep to enable said siphon pipe to telescope therein when the tank top moves downwardly relative to said tank bottom during coupling impacts, and also sufficiently wide to enable a rubber spider siphon pipe guide normally used in rubber lined tank cars to position and anchor itself in said sump; and a tapered portion extending from the bottom of said sump portion exteriorly of said tank bottom and longitudinally of said tank in both directions; said tapered portion being tapered upwardly from said sump portion to an end portion engaging said bottom of said tank; said tapered portion also extending a short distance transversely of said tank; said low profile sump being rigidly attached to said tank bottom adjacent said sump opening and at said end portion by welding; and void spaces in said tapered portion above said tapered wall.

2. A low profile tank car siphon pipe sump according to claim 1 wherein said tapered portion extends three (3) longitudinal units for each vertical unit.

3. A low profile tank car siphon pipe sump according to claim 1 wherein said sump opening is formed as a half of a sphere.

4. A low profile tank car siphon pipe sump according to claim 3 wherein said sphere has a diameter of at least about seven and three-fourths ($7\frac{3}{4}$) inches.

5. A low profile tank car siphon pipe sump according to claim 1 wherein void spaces are provided extending transversely of the tank.

6. A low profile tank car siphon pipe and tank car skid according to claim 5 wherein said tank car sump is a casting.

* * * * *

UNITED STATES PATENT AND TRADEMARK OFFICE

CERTIFICATE OF CORRECTION

PATENT NO. : 4,237,928

DATED : December 9, 1980

INVENTOR(S) : Robert C. Messersmith

It is certified that error appears in the above-identified patent and that said Letters Patent are hereby corrected as shown below:

In Column 1, line 33, please delete the first "of the"

In Column 3, line 10, "and" should read ---of---.

In Column 3, line 39, "about" should read ---above---.

Signed and Sealed this

*Twenty-second* Day of *September 1981*

[SEAL]

*Attest:*

GERALD J. MOSSINGHOFF

*Attesting Officer*

*Commissioner of Patents and Trademarks*